US011713159B1

(12) United States Patent
Zhan

(10) Patent No.: US 11,713,159 B1
(45) Date of Patent: Aug. 1, 2023

(54) FOLDABLE STORAGE BOX

(71) Applicant: Jianxing Zhan, Shenzhen (CN)

(72) Inventor: Jianxing Zhan, Shenzhen (CN)

( * ) Notice: Subject to any disclaimer, the term of this patent is extended or adjusted under 35 U.S.C. 154(b) by 0 days.

(21) Appl. No.: 17/851,511

(22) Filed: Jun. 28, 2022

(51) Int. Cl.
*B65D 21/08* (2006.01)
*B65D 25/08* (2006.01)
*B65D 25/30* (2006.01)
*B65D 6/18* (2006.01)

(52) U.S. Cl.
CPC ..... *B65D 11/1833* (2013.01); *B65D 21/086* (2013.01); *B65D 25/08* (2013.01); *B65D 25/30* (2013.01)

(58) Field of Classification Search
CPC ..... B65D 21/086; B65D 25/08; B65D 25/30; B65D 11/1846; B65D 11/1853; B65D 11/1833; B65D 2251/1016; B65D 25/06; B65D 2501/2421
USPC ..... 220/533, 4.29
See application file for complete search history.

(56) References Cited

U.S. PATENT DOCUMENTS 266,974 A * 11/1882 Cox ..... B65D 11/1833 220/7
1,230,831 A * 6/1917 Ickes ..... B65D 11/1833 220/7
5,515,987 A * 5/1996 Jacques ..... B65D 11/1833 220/6
6,209,742 B1 * 4/2001 Overholt ..... B65D 11/1833 220/6
10,065,763 B2 * 9/2018 Wilcox ..... B65D 21/086
2001/0027976 A1 * 10/2001 Murakami ..... B65D 25/205 220/6
2002/0108951 A1 * 8/2002 Zelko ..... B65D 11/1833 220/7
2003/0006232 A1 * 1/2003 Raghunathan ..... B65D 11/1833 220/7
2007/0145053 A1 * 6/2007 Escarpa Gil ..... B65D 11/1833 220/7
2010/0230406 A1 * 9/2010 Yamauchi ..... B65D 11/1833 220/7
2010/0320202 A1 * 12/2010 Yamauchi ..... B65D 11/1833 220/6
2012/0091133 A1 * 4/2012 Escarpa Gil ..... B65D 11/1833 220/7
2015/0090721 A1 * 4/2015 Woodruff ..... B65D 25/06 220/533

* cited by examiner

*Primary Examiner* — Andrew D Perreault
(74) *Attorney, Agent, or Firm* — Daniel M. Cohn; Howard M. Cohn

(57) ABSTRACT

A foldable storage box, comprising: a bottom panel, a first mounting assembly, a second mounting assembly. The bottom panel with two opposite first edges and two opposite second edges; the first mounting assembly comprises two first side plates rotatably connected to the first edges respectively, and two ends of the first side plate close to the second edge are both provided with a first clamping structure; the second mounting assembly comprises two second side plates rotatably connected to the second edges respectively, and two ends of the second side plates close to the first edge are both provided with a second clamping structure capable of a snap fit to the first clamping structure.

9 Claims, 5 Drawing Sheets

FOLDABLE STORAGE BOX

TECHNICAL FIELD

The present disclosure relates to a technical field of storage boxes, and in particular to a foldable storage box.

BACKGROUND

The storage box is widely used in people's daily life. In order to facilitate transportation and save transportation space, the storage box is usually divided into a plurality of independent mounting plates. After receiving the bulk mounting plates, the users need to butt-joint one by one, which is not only time-consuming but also not easy to install or even dislocate, which is very inconvenient.

SUMMARY

In order to solve the technical problem that the existing storage box is formed by a plurality of independent mounting plates butting, and the assembly is inconvenient, the present disclosure provides the foldable storage box, comprising: a bottom panel, a first mounting assembly, a second mounting assembly.

The bottom panel with two opposite first edges and two opposite second edges, the two first edges and the two second edges are jointly surrounded to form a quadrilateral.

The first mounting assembly comprises two first side plates rotatably connected to the first edge respectively, wherein the two first side plates can rotate toward or away from each other, and two ends of the first side plate close to the second edge are both provided with a first clamping structure.

The second mounting assembly comprises two second side plates rotatably connected to the second edge respectively, wherein the two second side plates can rotate toward or away from each other, and two ends of the second side plates close to the first edge are both provided with a second clamping structure capable of a snap fit to the first clamping structure.

Wherein the foldable storage box has two states, one is an assembled state in which the two first side plates and the two second side plates are connected end-to-end in sequence through clamping of the first clamping structure and the second clamping structure, and the other is a storage state in which the two first side plates and the two second side plates are both rotated towards each other to be overlapped on the bottom panel.

In one embodiment, each of the first side plates is provided with two mounting grooves facing the other first side plate, and groove walls of the mounting grooves are provided with the first clamping structure; two ends of the second side plate close to the first edge are both provided with concave stripes, the concave stripes are provided with a second clamping structure, the two concave stripes of each of the second side plates is respectively inserted into the mounting grooves of the two first side plates, and the second clamping structure is clamped and matched with the first clamping structure when the concave stripes are inserted into the mounting grooves. In one embodiment, a convex part is provided on the connecting arm; a concave part adapted to the convex part is provided on the circumferential side wall of the supporting plate; wherein, when the supporting plate rotates around the axis, each of the convex portions is alternately placed in the corresponding concave portion.

In one embodiment, the first side plate comprises a board body and two board folded edges, and the two board folded edges are respectively connected to two sides of the board body close to the second edge, and are bent toward the second edge relative to the board body, the board folded edge is provided with the first clamping structure, and when the foldable storage box is in the storage state, the bottom panel is located between the two board folded edges.

In one embodiment, the bottom panel is provided with a third clamping structure, and the first clamping structure is clamped to the third clamping structure when the foldable storage box is in the storage state.

In one embodiment, the mounting groove is provided on a first end surface of the board folded edge away from the board body; the first clamping structure further comprises a locking hole provided on an inner side of the board fold and penetrating into the mounting groove, and the second clamping structure further comprises a locking block provided on an inner side of the concave stripe, the third clamping structure comprises a limiting block provided on the side wall of the bottom panel, when the foldable storage box is in the assembled state, the locking block is clamped in the locking hole, and when the foldable storage box is in the storage state, the limiting block is clamped in the locking hole.

In one embodiment, the locking block has a guide surface inclined to an inner side surface of the concave stripe such that a thickness of the locking block gradually decreases in a direction toward the first edge.

In one embodiment, the first clamping structure comprises a clamping groove provided on the groove wall of the mounting groove, the second clamping structure comprises a clamping block provided on the concave stripe. When the concave stripe is inserted into the mounting groove, the clamping block is clamped in the clamping groove.

In one embodiment, the mounting groove is provided on a first end surface of the board folded edge away from the board body, the first side plate further comprises a limiting strip connected to the first end surface, the limiting strip is provided on an inner side of the mounting groove, the concave stripe is provided on the second end surface of the second side plate facing the first edge, the second end surface is provided with an escape groove on an inner side of the concave stripe for avoiding the limiting strip.

In one embodiment, the first side plate is provided with an avoidance hole for users to hold.

In one embodiment, the foldable storage box further comprises at least one series assembly, the series assembly comprises a series protrusion provided on the outer side of the second side plate and a series hole provided on the other second side plate.

In one embodiment, the foldable storage box further comprises a spacer board, and at least one slide is provided on an inner side of the second side plate, and the slide extends along a strip-shaped path perpendicular to the second edge, the spacer board is slidably connected to the slide.

In one embodiment, a limiting groove is provided on the bottom panel, and the spacer board slidably connected to the slide is inserted into the limiting groove.

The foldable storage box provided by the present disclosure has beneficial effects as follows.

The foldable storage box can be assembled to form an assembled state when needed, and disassembled to form a stored state when not needed.

Since the first side plate and the second side plate are both rotatably connected to the bottom panel, the assembly steps of the first side plate and the second side plate and the bottom panel are saved, at the same time, the included angle between the first side plate and the second side plate is fixed, and the considered angle adjustment is omitted; and when the foldable storage box is in the storage state, the space can be saved, which is convenient for storage, and the loss of components of the foldable storage box can also be avoided.

BRIEF DESCRIPTION OF DRAWINGS

In order to more clearly illustrate technical solutions in embodiments of the present disclosure, drawings required in description or prior art are briefly introduced below, and obviously, the drawings in the following description are merely some embodiments of the present disclosure. For a person having ordinary skill in art, other drawings may be obtained according to the drawings without creative efforts.

Figure 1:
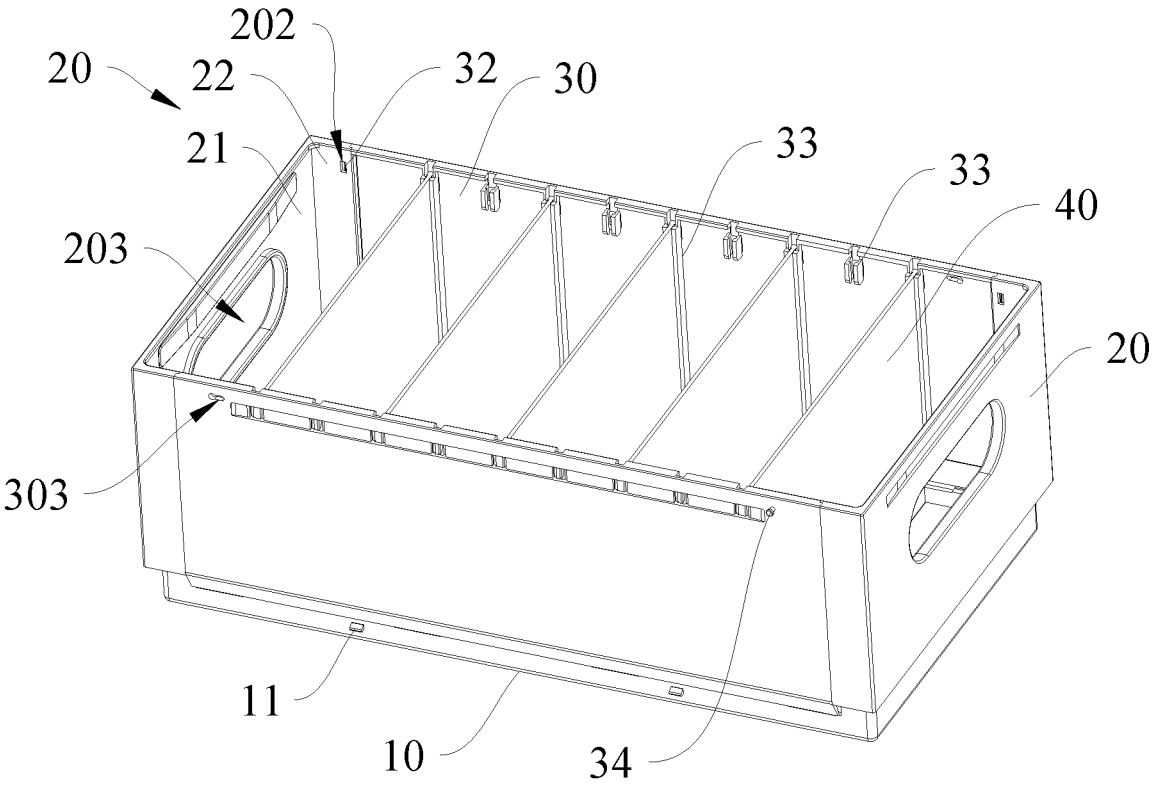
FIG. 1 is a three-dimensional schematic diagram of a foldable storage box when is in the assembled state according to one embodiment of the present disclosure.

| Reference number in the drawings: | | | |
|---|---|---|---|
| bottom panel | 10 | limiting block | 11 |
| first edge | 101 | second edge | 102 |
| limiting groove | 103 | limiting hole | 104 |
| first side plate | 20 | board body | 21 |
| board folded edge | 22 | mounting groove | 201 |
| locking hole | 202 | avoidance hole | 203 |
| limiting strip | 23 | first clamping structure | 24 |
| second side plate | 30 | guiding beveled surface | 301 |
| escape groove | 302 | series hole | 303 |
| concave stripe | 31 | second clamping structure | 311 |
| locking block | 32 | guide surface | 321 |
| slide | 33 | series protrusion | 34 |
| spacer board | 40 | | |

DETAILED DESCRIPTION

The following describes in detail the embodiments of the present disclosure, examples of which are illustrated in the accompanying drawings, wherein the same or similar reference numerals refer to the same or similar elements or elements having the same or similar functions throughout. The embodiments described below with reference to the accompanying drawings are exemplary, and are not intended to limit the present disclosure.

In the description of the present disclosure, it should be understood that orientation or positional relationship indicated by terms "length", "width", "upper", "lower", "front", "rear", "left", "right", "vertical", "horizontal", "top", "bottom", "inner", "outer" and so on are based on the orientation or positional relationship shown in the drawings, rather than indicating or implying that an indicated device or an indicated element must have a particular orientation, are constructed and operated in a particular orientation, and are therefore not to be construed as limiting the present disclosure.

In addition, terms such as "first" and "second" are only used for the purpose of description, rather than being understood to indicate or imply relative importance or hint the number of indicated technical features. Thus, the feature limited by "first" and "second" can explicitly or impliedly include at least one feature. In the description of the present disclosure, the meaning of "a plurality of" is at least two, unless otherwise specified.

In the present disclosure, the terms such as "mounting", "connected", "connected to", "fixed at", and the others should be understood in a broad sense unless expressly stated or limited otherwise; for example, it may be a fixed connection or a detachable connection, or integrated; it can be a mechanical connection or an electrical connection; it can be a direct connection or an indirect connection through an intermediate medium, and it can be the internal connection of the two elements or the interaction relationship between the two elements. For a person having ordinary skill in art, the specific meanings of the above terms in the present invention can be understood according to specific situations.

In order to make the purpose, technical solutions, and advantages of the present disclosure clear, the following further describes the present disclosure in detail with reference to accompanying drawings and embodiments.

The present disclosure provides a foldable storage box which enables folding storage and quick assembly.

The foldable storage box comprises a bottom panel 10, a first mounting assembly, a second mounting assembly.

Figure 2:
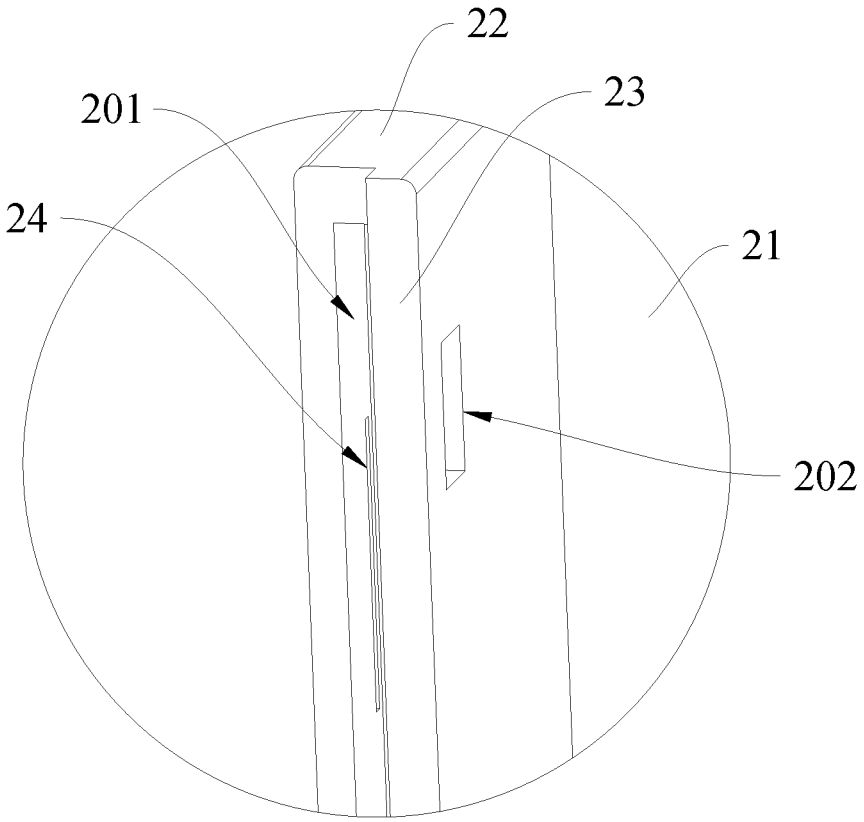
FIG. 2 is an enlarged partial view of the first side plate of FIG. 1.
Figure 3:
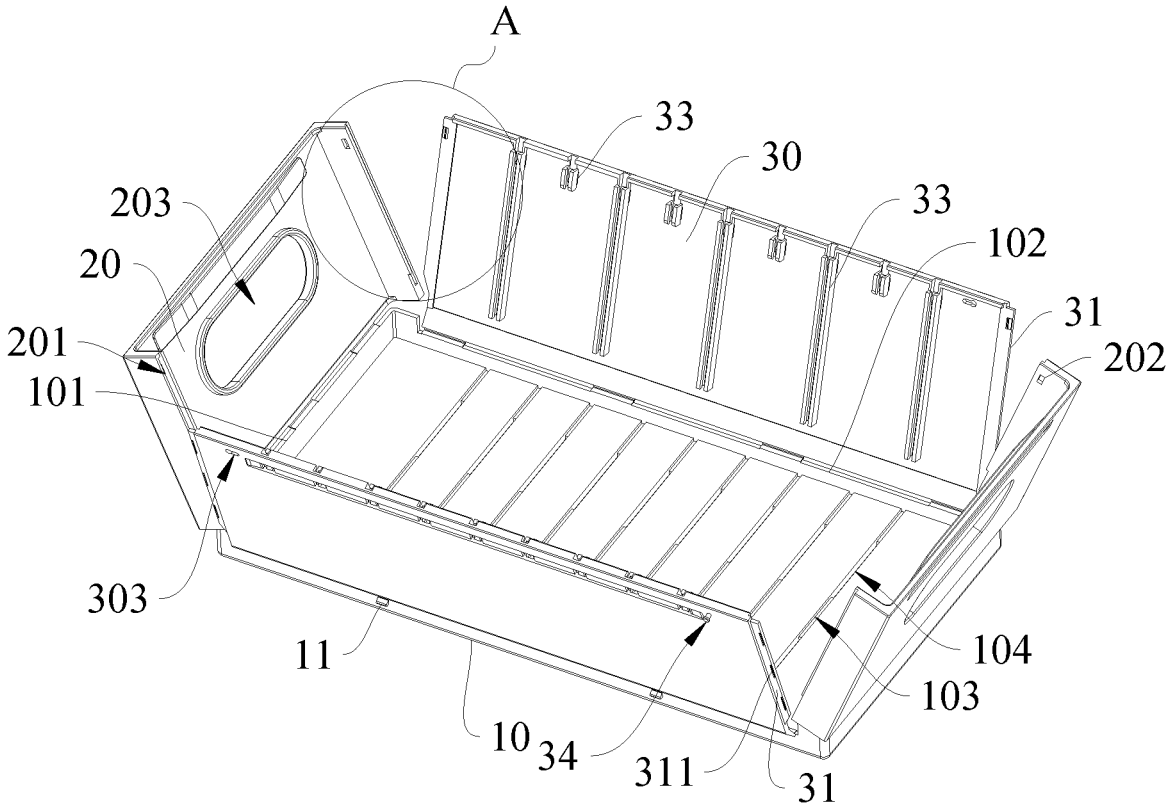
FIG. 3 is a three-dimensional schematic diagram of a foldable storage box when the first side plate and the second side plate are not assembled according to one embodiment of the present disclosure.

Referring to FIG. 1 to FIG. 3, a cross-section of the bottom panel 10 can be a quadrilateral, the bottom panel 10 with two opposite first edges 101 and two opposite second edges 102, the two first edges 101 and the two second edges 102 are jointly surrounded to form a quadrilateral; A length of the second edge 102 can be set to be greater than a length of the first edge 101. At this time, an extension direction of the first edge 101 is a width direction of the bottom panel 10, and an extension direction of the second edge 102 is a length direction of the bottom panel 10.

Referring to FIG. 2, the first mounting assembly comprises two first side plates 20 rotatably connected to the first edges 101 respectively, wherein the two first side plates 20 can rotate toward or away from each other, and two ends of the first side plate 20 close to the second edge 102 are both provided with a first clamping structure 24. Wherein, a rotational axis of the first side plate 20 is parallel to the first edge 101 of its rotational connection, and the two first side plates 20 are arranged in mirror images.

Referring to FIG. 2, the second mounting assembly comprises two second side plates 30 rotatably connected to the second edges 102 respectively, wherein the two second side plates 30 can rotate toward or away from each other, and two ends of the second side plates 30 close to the first edge 101 are both provided with a second clamping structure 311 capable of a snap fit to the first clamping structure 24. Wherein, a rotational axis of the second side plate 30 is parallel to the second edge 102 of its rotational connection, and the two second side plates 30 are arranged in mirror images.

Wherein the foldable storage box has two states, one is an assembled state in which the two first side plates 20 and the two second side plates 30 are connected end-to-end in sequence through clamping of the first clamping structure 24 and the second clamping structure 311. That is, when the two first clamping structures 24 of each of the first side plates 20 are respectively engaged with the second clamping structures 311 on the same side of the two adjacent second side plates 30, the foldable storage box is in the assembled state. At this time, the two first side plates 20, the two second side walls and the bottom panel 10 are jointly formed to form a storage groove for storing items. And the other is a storage state in which the two first side plates 20 and the two second side plates 30 are both rotated towards each other to be overlapped on the bottom panel 10. That is, the first side plate 20 and the second side plate 30 are released from the clamping connection between the first clamping structure 24 and the second clamping structure 311, and both are rotated inward, until the first side plate and the second side plate are sequentially stacked together on the bottom plate 10, the foldable storage box is in the storage state.

The foldable storage box can be assembled to form an assembled state when needed, and disassembled to form a stored state when not needed. Since the first side plate 20 and the second side plate 30 are both rotatably connected to the bottom panel 10, the assembly steps of the first side plate 20 and the second side plate 30 and the bottom panel 10 are saved, at the same time, the included angle between the first side plate 20 and the second side plate 30 is fixed, and the considered angle adjustment is omitted; and when the foldable storage box is in the storage state, the space can be saved, which is convenient for storage, and the loss of components of the foldable storage box can also be avoided.

In one embodiment, each of the first side plates 20 is provided with two mounting grooves 201 facing the other first side plate 20; the two mounting grooves 201 are respectively close to the two second edges 102, and groove walls of the mounting grooves 201 are provided with the first clamping structure 24; two ends of the second side plate 30 close to the first edge 101 are both provided with concave stripes 31, the concave stripes 31 are provided with the second clamping structure 311, the two concave stripes 31 of each of the second side plates 30 are respectively inserted into the mounting grooves 201 of the two first side plates 20, and the second clamping structure 311 is clamped and matched with the first clamping structure 24 when the concave stripes 31 are inserted into the mounting grooves 201.

Figure 5:
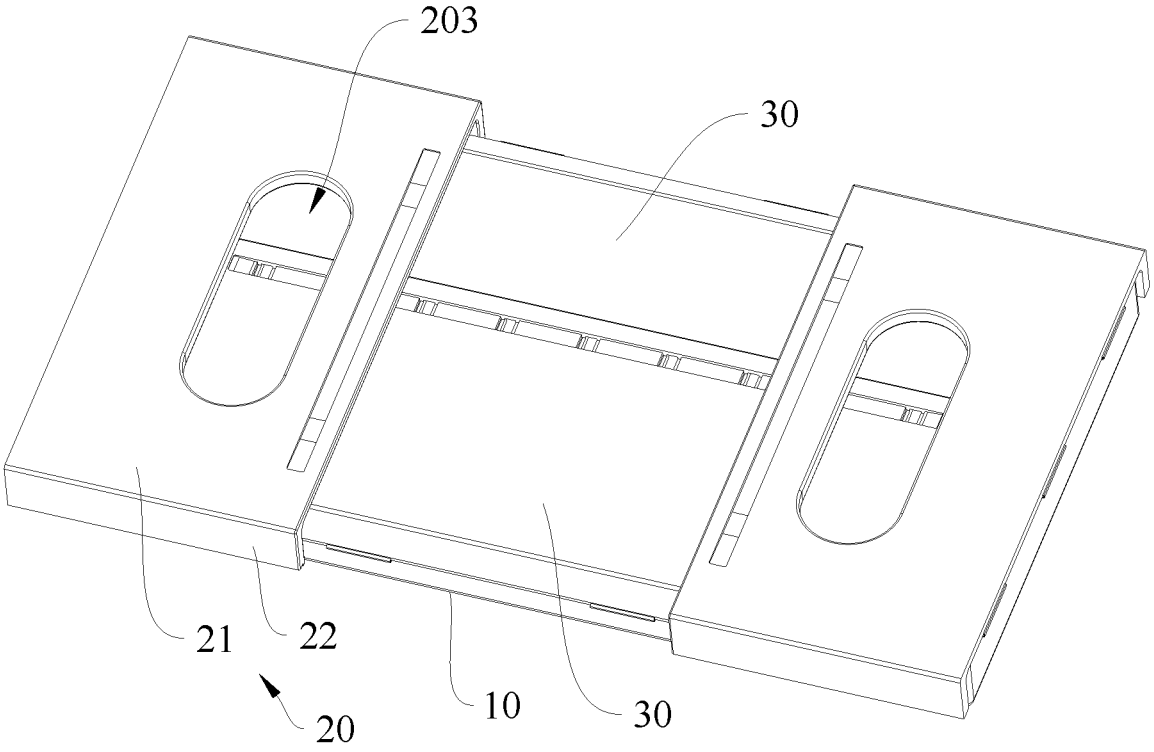
FIG. 5 is a three-dimensional schematic diagram of the foldable storage box when it is in a storage state according to one embodiment of the present disclosure.

When the foldable storage box needs to be assembled, the two second side plates 30 are firstly rotated to an assembly position, and then one of the first side plates 20 is rotated from the outside to the inside until the same-side concave stripes 31 of the two second side plates 30 are respectively inserted into the two mounting grooves 201 of rotating the first side plate 20. A rotation of the second side plate 30 is limited the groove wall of the mounting groove 201, and the two first clamping structures 24 on the first side plate 20 can be respectively clamped with the second clamping structures 311 on the two concave stripes 31 during the process of inserting the concave stripe 31 into the mounting groove 201, so that a rotation of the first side plate 20 is restricted, and thus a positioning of the first side plate 20 and the two second side plates 30 is achieved. And then the other first side plate 20 is rotated from the outside to the inside until the other side concave stripe 31 of the two second side plates 30 are respectively inserted into the two mounting grooves 201 of the rotating first side plate 20. At this time, the two first clamping structures 24 on the first side plate 20 are clamped with the second clamping structures 311 on the two concave stripes 31, so that a rotation of the first side plate 20 is restricted, and thus the positioning of the other first side plate 20 and the two second side plates 30 is achieved. By this way, the foldable storage box is in the assembled state, and the two first side plates 20 and the two second side plates 30 are forming the storage groove of the foldable storage box together with the bottom panel 10. When the first side plate 20 and the second side plate 30 are assembled, it is only necessary to ensure an insertion of the concave stripe 31 and the mounting groove 201, so that a clamping connection between the first clamping structure 24 and the second clamping structure is achieved and a manual snapping operation is eliminated, resulting in a quick assembly of the foldable storage box. Referring to FIG. 5, when the foldable storage box needs to be stored, only an external force is required to pull out the concave stripe 31 from the mounting groove 201. Then the first side plate 20 and the second side plate 30 are rotated inward until each of the first side plate 20 and the second side plate 30 is stacked above the bottom panel 10, so that the foldable storage box is deformed into the storage state.

It should be noted that an inner side is an accommodating groove side of the bottom panel 10; an inner side of the first side plate 20 is the side of the first side plate 20 facing the other first side plate 20; an inner side of the second side plate 30 is the side of the second side plate 30 facing the other second side plate 30.

In one embodiment, referring to FIG. 3, the cross section of the bottom panel 10 is a rectangle, at this time, the two first edges 101 are symmetrical, and the two second edges 102 are symmetrical. The bottom panel 10 can be bent to form an accommodating groove with an upward opening. The accommodating groove has four groove walls opposite to each other, the two first edges 101 are provided at the notches of the two opposite groove walls, and the two second edges 102 are provided at the notches of the other two opposite groove walls. Wherein, a height of the accommodating groove wall on a side of the first edge 101 of the bottom panel 10 can be greater than a height of the groove wall of the accommodating groove on a side of the second edge 102 of the bottom panel 10, so that when the foldable storage box needs to be stored, it can be firstly rotated the second side plate 30 inward so that the two second side plates 30 are stacked in the accommodating groove, and then rotates the two first side plates 20 until the first side plates 20 are stacked above the second side plates 30. Heights of the groove walls of the accommodating grooves are not uniform, so that the first side plate 20 and the second side plate 30 are stacked in sequence in order to prevent squeezing deformation.

Figure 4:
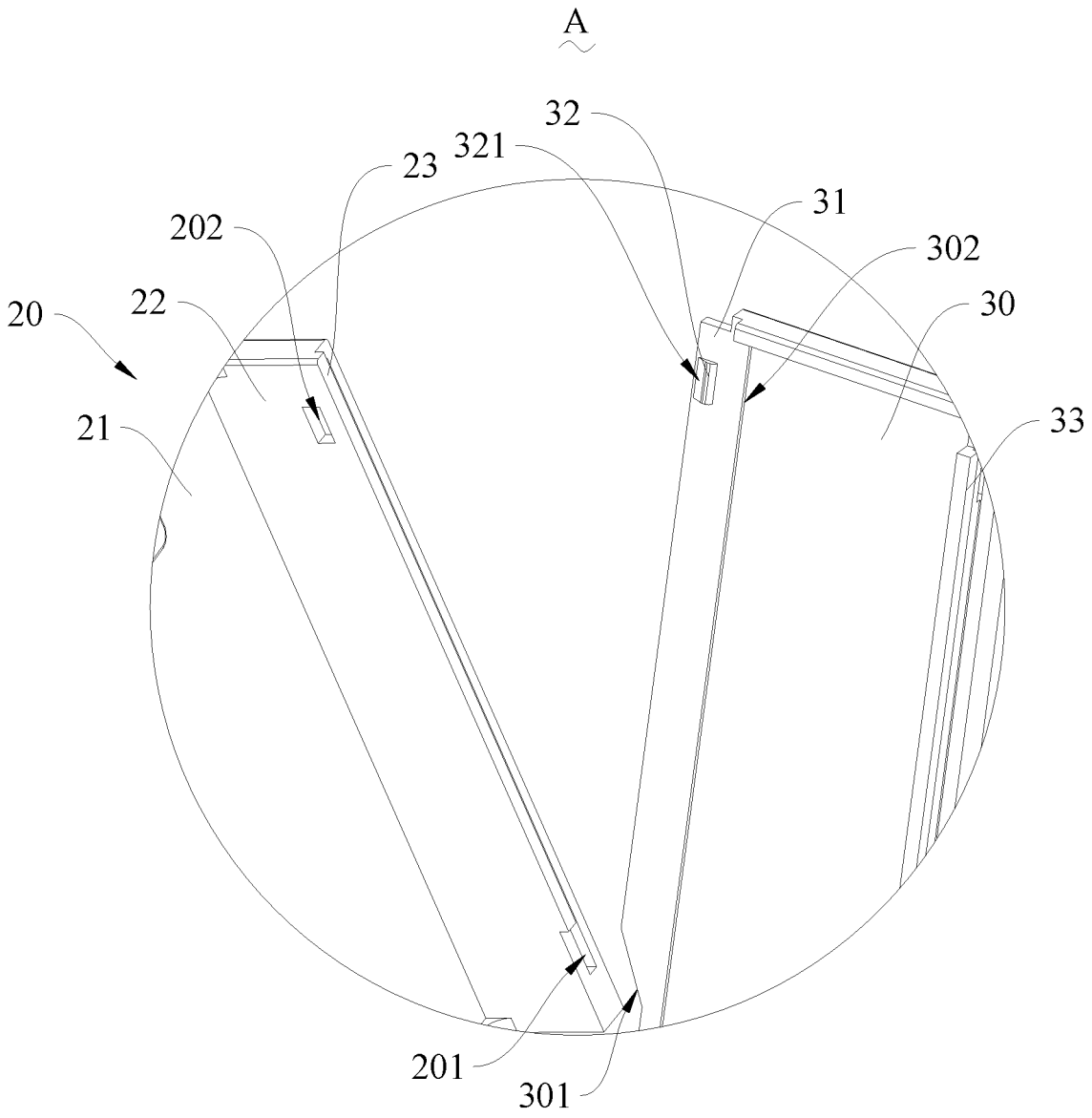
FIG. 4 is a partial enlarged view of portion A shown in FIG. 3

In one embodiment, referring to FIG. 2 and FIG. 4, the first clamping structure 24 comprises a clamping groove provided on the groove wall of the mounting groove 201, correspondingly, the second clamping structure 311 comprises a clamping block provided on the concave stripe 31. When the concave stripe 31 is inserted into the mounting groove 201, the clamping block on the concave stripe 31 is clamped in the clamping groove in the corresponding mounting groove 201. Wherein, the cross-section of the clamping block can be semicircular, so that the concave stripe 31 can be inserted into the mounting groove 201. It should be noted that the mounting groove 201 of the first side plate 20 is slightly elastically deformed due to the support of the clamping block during the process of inserting the concave stripe 31 into the mounting groove 201.

In other embodiments, the first clamping structure 24 comprises a clamping block provided on the groove wall of the mounting groove 201, the second clamping structure 311 comprises a clamping groove provided on the concave stripe 31. There is no limitation as long as the first clamping structure 24 and the second clamping structure 311 are a snap fit to each other.

Optionally, a plurality of clamping grooves and clamping blocks can be provided. A plurality of clamping grooves are arranged at intervals along the extending direction of the mounting groove 201 and a plurality of clamping blocks are arranged at intervals along the extension direction of the concave stripe 31, in order to enhance the stability of the connection of the first side plate 20 and the second side plate 30.

Particularly, referring to FIG. 1 and FIG. 3, the first side plate 20 comprises a board body 21 and two board folded edges 22, and the two board folded edges 22 are respectively connected to two sides of the board body 21 close to the second edge 102, and are bent toward the second edge 102 relative to the board body 21. That is, the two board folded edges 22 are both bent toward the inner side of the board body 21, and the board folded edge 22 and the board body 21 are arranged at an included angle. In one embodiment, the two board folded edges 22 are mirrored to maintain the symmetry of the foldable storage box. The extension length of the board body 21 is equal to the extension length of the first edge 101, and an included angle between the board folded edge 22 and the board body 21 is 90°. The board folded edge 22 is extended along the second edge 102 when the foldable storage box is in the assembled state. Wherein, the board body 21 has a first end surface away from the board body 21, and the mounting groove 201 is provided on the first end surface. The setting of the board folded edge 22 is convenient to deepen the depth of the mounting groove 201, so as to improve the stability after the concave stripe 31 is inserted into the mounting groove 201 and prevent the concave stripe 31 from coming out of the mounting groove 201.

Wherein, referring to FIG. 3 and FIG. 4, a longer mounting groove can increase an amount of deformation where a groove wall of the mounting groove 201 is elastically deformed, which is convenient for the clamping block to come out from the clamping groove. An extension direction of the concave stripe 31 is perpendicular to the extension direction of the second edge 102, and an extension length of the mounting groove 201 is not less than the extension length of the concave stripe 31. Since the concave stripe 31 is engaged with the mounting groove 201, the first side plate 20 is rotated inward. At this time, one end of the concave stripe 31 close to the bottom panel 10 is first inserted into the mounting groove 201 in order to align the concave stripe 31 with the mounting groove 201. The concave stripe 31 is provided with a guiding beveled surface 301 close to one end of the bottom panel 10, the guiding beveled surface 301 can avoid the corner portion of the board folded edge 22 near the bottom panel 10, so that it enables the user to align the concave stripe 31 with the mounting groove 201 when the first side plate 20 is sufficiently close to the second side plate 30. In this way, the alignment of the concave stripe 31 and the mounting grooves 201 is more precise. Therefore, the quick insertion of the concave stripe 31 and the mounting grooves 201 is achieved.

In one embodiment, the distance between the two board folded edges 22 is greater than the extension length of the first edge 101. When the first side plate 20 is turned inward to the folded state, the bottom panel 10 is located between the two board folded edges 22, so as to save space.

Optionally, referring to FIG. 2 and FIG. 4, the first side plate 20 further comprises a limiting strip 23 connected to the first end surface. The limiting strip 23 is provided on an inner side of the mounting groove 201 and is flush with an inner side wall of the mounting groove 201. The concave stripe 31 is provided on a second end surface of the second side plate 30 facing the first edge 101. The second end surface is provided with an escape groove 302 on an inner side of the concave stripe 31 for avoiding the limiting strip 23. When the concave stripe 31 and the mounting groove 201 need to be a snap fit, firstly, the limiting strip 23 is placed on the inner side of the concave stripe 31, and then the limiting strip 23 is rotated the first side plate 20 against the concave stripe 31 until the concave stripe 31 is inserted into the mounting groove 201. At this time, the limiting concave stripe 31 is played a guiding role for the concave stripe 31, facilitating the quick assembly of the first side plate 20 and the second side plate 30. The escape groove 302 is used to avoid the limiting strip 23. After the first clamping structure 24 is engaged with the second clamping structure 311, the limiting strip 23 abuts against the groove wall of the escape groove 302 to restrain the first side plate 20.

In one embodiment, referring to FIG. 2, the clamping groove is provided on the groove wall facing inwards of the mounting groove 201, and the clamping block is provided on an outside of the concave stripe 31. Since a width of the mounting groove 201 is narrow, a height setting of the clamping block is limited, so that the clamping block can be disengaged from the clamping groove with a small external force. To solve this problem, referring FIG. 3 and FIG. 4, the second clamping structure 311 further comprises a locking block 32 provided on the inner side of the concave stripe 31. The first clamping structure 24 further comprises a locking hole 202 provided on an inner side of the board folded edge 22 and penetrating into the mounting groove 201. When the first clamping structure 24 is a snap fit to the second clamping structure 311, the locking block 32 is engaged in the locking hole 202. Due to the setting of the limiting strip 23, the locking hole 202 is provided on the inner side of the board folded edge 22, so that the structural strength of the locking hole 202 can be improved. Meanwhile, the limiting strip 23 can be used as an extension of the groove wall of the mounting groove 201, so as to increase the deformability of the groove wall of the mounting groove 201. When the concave stripe 31 is inserted into the mounting groove 201, the locking block 32 is pushed up the inner groove wall of the mounting groove 201, so that the inner groove wall is elastically deformed until the locking block 32 is snapped into the locking hole 202. An outer side of the concave stripe 31 is limited by the clamping connection between the first clamping structure 24 and the second clamping structure 311. An inner side of the concave stripe 31 is limited by the clamping connection between the locking block 32 and the locking hole 202, so as to prevent the concave stripe 31 from coming out of the mounting groove 201. When the first side panel 20 and the second side panel 30 need to be opened, the users can press the locking block 32 forcefully through the locking hole 202, so that an outer groove wall of the mounting groove 201 is slightly elastically deformed and the locking block 32 is come out of the locking hole 202. Then, the inner groove wall of the mounting groove 201 is lifted up, and the first side plate 20 is rotated outward, so that the concave stripe 31 is pulled out from the mounting groove 201. In this way, the first side plate 20 and the second side plate 30 are locked through a snap fit between the locking block 32 and the locking hole 202. At this time, the first side plate 20 and the second side plate 30 can be unlocked only when the external force pushes the locking block 32, and the first side plate 20 and the second side plate 30 are prevented from being separated due to the pressing of the items in the storage groove.

Wherein, the locking block 32 is provided on one end of the concave stripe 31 away from the bottom panel 10, and correspondingly, the locking hole 202 is also provided on one end of the board folded edge 22 away from the bottom panel 10, so as to facilitate the users to perform the unlocking operation. Meanwhile, when the locking block 32 moves into the mounting groove 201, most of the area of the concave stripe 31 is inserted into the mounting groove 201. Through the above method, the stability of inserting the concave stripe 31 into the mounting groove 201 is improved, and the locking block 32 is facilitated to lift the inner groove wall of the mounting groove 201. It is also avoided that part of the concave stripe 31 is disengaged from the mounting groove 201 during the process that the locking block 32 is pushed up the limiting strip 23.

In order to facilitate the locking block 32 to push up the inner groove wall of the mounting groove 201, referring to FIG. 4, the locking block 32 comprises a guide surface 321 inclined to the inner side surface of the concave stripe 31, so that the thickness of the locking block 32 is gradually decreased in the direction toward the first edge 101. In this way, a deformation of the inner groove wall of the mounting groove 201 is gradually increased as the concave stripe 31 is inserted toward the mounting groove 201, so as to prevent the inner groove wall of the mounting groove 201 from breaking due to the sudden increase of the deformation amount.

In one embodiment, referring to FIG. 4 and FIG. 5, when the foldable storage box is in the storage state, the second side plate 30 is located between the first side plate 20 and the bottom panel 10; the bottom panel is provided with a third clamping structure, and the first clamping structure is clamped to the third clamping structure when the foldable storage box is in the storage state. Thus, the first side plate 20 is connected to the bottom panel 10 through a snap fit between the first clamping structure 24 with the third clamping structure, thereby limiting the rotation of the first side plate 20. At the same time, the second side plate 30 is also limited between the first side plate 20 and the bottom panel 10. Therefore, the rotation of the second side plate 30 is restricted, and the scattered shaking of the foldable storage box in the storage state is avoided.

Specifically, the third clamping structure comprises a limiting block 11 provided on the side wall of the bottom panel 10; the limiting block 11 is located on the lower side of the second side plate 30. When the foldable storage box is in the storage state, the board folded edge 22 is a snap fit to the limiting block 11 through the locking hole 202 to limit the rotation of the first side plate 20. The first side plate 20 is stacked above the second side plate 30 to limit the rotation of the second side plate 30, so that the foldable storage box is stably kept in the storage state, which is convenient for transportation.

In one embodiment, referring to FIG. 1, the first side plate 20 is provided with an avoidance hole 203. The avoidance hole 203 is opened larger that the users insert their hand into the avoidance hole 203 to lift the foldable storage box in the assembled state. Wherein, a flanging is provided at the hole edge of the avoidance hole 203 so as to increase the area of the hole wall of the avoidance hole 203, thereby increasing the contact area with the user's finger and avoiding the user's hand restraint.

In one embodiment, the foldable storage box further comprises at least one series assembly, referring to the FIG. 1 and FIG. 3, the series assembly comprises a series protrusion 34 provided on an outer side of the second side plate 30 and a series hole 303 provided on the other second side plate 30. When multiple foldable storage boxes need to be connected in series, the series protrusion 34 of one side adjacent foldable storage box can be inserted into the series hole 303 of the foldable storage box and the series protrusion 34 of the foldable storage box is inserted into the series hole 303 of the adjacent foldable storage box on the other side, so that a plurality of foldable storage holes are sequentially connected in series.

Wherein, in order to make a plurality of the series foldable storage boxes flush, the connection between the series protrusion 34 and the series hole 303 is parallel to the first edge 101.

Optionally, in order to avoid separation of two adjacent foldable storage boxes, the series hole 303 comprises a strip-shaped hole and a perforated hole communicating with one end of the strip-shaped hole. And the width of the perforated hole is greater than the width of the strip-shaped hole. The series protrusion 34 comprises a series rod connected to the second side plate 30 and a series cap connected to the extension end of the series rod. The maximum width of the series cap is greater than the width of the series rod, also greater than the width of the strip-shaped hole and less than the width of the perforated hole. The width of the series rod can be less than or equal to the width of the strip-shaped hole. At this time, the series cap can restrict the series rod disengaged from the strip-shaped hole, so as to achieve the limit of two adjacent foldable storage boxes. Wherein, when the cross-sections of the series rod and the series cap are both circular, the width of the series rod and the series cap may refer to the diameter of the series rod and the series cap, and the width of the perforated hole refers to the aperture of the perforated hole.

In one embodiment, referring to FIG. 1, the foldable storage box further comprises a spacer board 40, and at least one slide 33 is provided on an inner side of the second side plate 30, and the slide 33 extends along a strip-shaped path perpendicular to the second edge 102, the spacer board 40 is slidably connected to the slide 33. In this way, the storage groove is divided into a plurality of storage spaces by the spacer board 40, so as to facilitate the classified storage of different items.

Optionally, referring to FIG. 1 and FIG. 3, the slides are provided on inner sides of the two second side plates, and connection of the two slides are parallel to the extension path of the first edges, so that the storage grooves are divided neatly. A plurality of spacer boards 40 can be provided, and accordingly, a plurality of slides 33 can be provided, and the number of slides 33 can be greater than or equal to the number of spacer boards 40. A plurality of slides 33 are arranged at intervals along the extending direction of the second edge 102. The slides 33 on the two second side plates 30 are arranged symmetrically, the users can select the slide 33 to which the spacer board 40 is connected according to the requirements of the storage space.

Wherein, the plurality of the slides 33 can be alternately arranged with different lengths to meet the mounting requirements of the different spacer boards 40.

Referring to FIG. 3, in order to limit the deformation of the spacer board 40, the bottom panel 10 is provided with a limiting groove 103, and the spacer board 40 slidably connected to the slide 33 is inserted into the limiting groove 103. The groove wall of the limiting groove 103 can restrict bending deformation of the portion of the spacer board 40 inserted into the limiting groove 103. In order to improve the insertion stability, the bottom of the limiting groove 103 is provided with a limiting hole 104, and the bottom of the spacer board 40 is provided with a limiting protrusion, and the limiting protrusion is inserted into the limiting hole 104.

Above are only preferred embodiments of the present disclosure and are not intended to limit the present disclosure. Any modification, equivalent replacement and improvement made within spirit and principle of the present disclosure should be included in protective scope of the present disclosure.

What is claimed is:

1. A foldable storage box, comprising:

a bottom panel, the bottom panel with two opposite first edges and two opposite second edges, the two first edges and the two second edges are jointly surrounded to form a quadrilateral;

a first mounting assembly, the first mounting assembly comprises two first side plates rotatably connected to the first edges respectively, wherein the two first side plates can rotate toward or away from each other, and two ends of the first side plate close to the second edge are both provided with a first clamping structure;

a second mounting assembly, the second mounting assembly comprises two second side plates rotatably connected to the second edges respectively, wherein the two second side plates can rotate toward or away from each other, and two ends of the second side plates close to the first edges are both provided with a second clamping structure capable of a snap fit to the first clamping structure;

wherein the foldable storage box has two states, one is an assembled state in which the two first side plates and the two second side plates are connected end-to-end in sequence through clamping of the first clamping structure and the second clamping structure, and the other is a storage state in which the two first side plates and the two second side plates are both rotated towards each other to be overlapped on the bottom panel;

wherein each of the first side plates is provided with two mounting grooves facing the other first side plate, and groove walls of the mounting grooves are provided with the first clamping structure; two ends of the second side plate close to the first edge are both provided with concave stripes, and the concave stripes are provided with the second clamping structure, the two concave stripes of each of the second side plates are respectively inserted into the mounting grooves of the two first side plates, and the second clamping structure is a snap fit to the first clamping structure when the concave stripes are inserted into the mounting grooves;

wherein the first side plate comprises a board body and two board folded edges, and the two board folded edges are respectively connected to two sides of the board body close to the second edge, and are bent toward the second edge relative to the board body, the board folded edge is provided with the first clamping structure, and when the foldable storage box is in the storage state, the bottom panel is located between the two board folded edges;

wherein the bottom panel is provided with a third clamping structure, and the first clamping structure is clamped to the third clamping structure when the foldable storage box is in the storage state;

wherein the mounting groove is provided on a first end surface of the board folded edge away from the board body, the first clamping structure further comprises a locking hole provided on an inner side of the board folded edge and penetrating into a locking hole of the mounting groove, and the second clamping structure further comprises a locking block provided on an inner side of the concave stripe; the third clamping structure comprises a limiting block provided on the side wall of the bottom panel, when the foldable storage box is in the assembled state, the locking block is clamped in the locking hole, and when the foldable storage box is in the storage state, the limiting block is clamped in the locking hole.

2. The foldable storage box of claim 1, the locking block has a guide surface inclined to an inner side surface of the concave stripe such that a thickness of the locking block gradually decreases in a direction toward the first edge.

3. The foldable storage box of claim 1, the first clamping structure comprises a clamping groove provided on a groove wall of the mounting groove, the second clamping structure comprises a clamping block provided on the concave stripe; when the concave stripe is inserted into the mounting groove, the clamping block is clamped in the clamping groove.

4. The foldable storage box of claim 1, wherein the mounting groove is provided on a first end surface of the board folded edge away from the board body, the first side plate further comprises a limiting strip connected to the first end surface, the limiting strip is provided on an inner side of the mounting groove, the concave stripe is provided on the second end surface of the second side plate facing the first edge, the second end surface is provided with an escape groove on an inner side of the concave stripe for avoiding the limiting strip.

5. The foldable storage box of claim 1, wherein the first side plate is provided with an avoidance hole for users to hold.

6. The foldable storage box of claim 1, wherein the foldable storage box further comprises at least one series assembly, the series assembly comprises a series protrusion provided on the outer side of the second side plate and a series hole provided on the other second side plate.

7. The foldable storage box according to claim 1, wherein the foldable storage box further comprises a spacer board, and at least one slide is provided on an inner side of the second side plate, and the slide extends along a strip-shaped path perpendicular to the second edge, the spacer board is slidably connected to the slide.

8. The foldable storage box according to claim 7, wherein a limiting groove is provided on the bottom panel, and the spacer board slidably connected to the slide is inserted into the limiting groove.

9. A foldable storage box, comprising:

a bottom panel, the bottom panel with two opposite first edges and two opposite second edges, the two first edges and the two second edges are jointly surrounded to form a quadrilateral;

a first mounting assembly, the first mounting assembly comprises two first side plates rotatably connected to the first edges respectively, wherein the two first side plates can rotate toward or away from each other, and two ends of the first side plate close to the second edge are both provided with a first clamping structure;

a second mounting assembly, the second mounting assembly comprises two second side plates rotatably connected to the second edges respectively, wherein the two second side plates can rotate toward or away from each other, and two ends of the second side plates close to the first edges are both provided with a second clamping structure capable of a snap fit to the first clamping structure;

wherein the foldable storage box has two states, one is an assembled state in which the two first side plates and the two second side plates are connected end-to-end in sequence through clamping of the first clamping structure and the second clamping structure, and the other is a storage state in which the two first side plates and the two second side plates are both rotated towards each other to be overlapped on the bottom panel;

two ends of the second side plate close to the first edge are both provided with concave stripes, the second clamping structure further comprises a locking block provided on an inner side of the concave stripe; the locking block has a guide surface inclined to an inner side surface of the concave stripe such that a thickness of the locking block gradually decreases in a direction toward the first edge.

* * * * *